US005542786A

United States Patent [19]

Blum

[11] Patent Number: 5,542,786

[45] Date of Patent: Aug. 6, 1996

[54] APPARATUS FOR MONITORING GROUT PRESSURE DURING CONSTRUCTION OF AUGER PRESSURE GROUTED PILING

[75] Inventor: Kenneth J. Blum, Parkville, Mo.

[73] Assignee: Berkel & Company Contractors, Inc., Bonner Springs, Kans.

[21] Appl. No.: 410,866

[22] Filed: Mar. 27, 1995

[51] Int. Cl.[6] ..... E02D 5/36; G01F 23/40

[52] U.S. Cl. ..... 405/240; 405/241; 73/715

[58] Field of Search ..... 175/113, 253; 405/240, 241; 73/715

[56] References Cited

U.S. PATENT DOCUMENTS

| | | | |
|---|---|---|---|
| 3,200,599 | 8/1965 | Phares et al. | 405/241 |
| 3,255,592 | 6/1966 | Moor | 405/241 X |
| 3,657,894 | 4/1972 | Parez | 405/241 |
| 4,575,283 | 3/1986 | Guandalini et al. | 405/240 |
| 4,966,498 | 10/1990 | Blum | 405/233 |
| 5,064,360 | 11/1991 | Blum | 417/519 |
| 5,073,080 | 12/1991 | Blum | 414/739 |
| 5,242,027 | 9/1993 | Blum | 175/84 |

FOREIGN PATENT DOCUMENTS

| | | | |
|---|---|---|---|
| 82121 | 4/1987 | Japan | 405/240 |
| 292408 | 12/1990 | Japan | 405/240 |

*Primary Examiner*—David J. Bagnell
*Attorney, Agent, or Firm*—Hovey, Williams, Timmons & Collins

[57] ABSTRACT

An apparatus for monitoring grout pressure in an auger assembly during construction of an auger pressure grouted piling includes a pressure sensing element positioned within the lower end of a hollow auger for sensing the pressure exerted on the pressure sensing element by grout supplied through the auger during installation of the piling. A pressure indicator is provided for displaying the pressure sensed at the element, and a transmission line connects the element and indicator for transmitting the pressure sensed at the element to the indicator. The sensing element preferably includes a fluid-filled bulb that is compressible so that pressure exerted on the bulb is transmitted to the fluid in the bulb, and the transmission line includes a first fluid line section connected to the sensing bulb, a second fluid line section connected to the pressure indicator, and a swivel coupling positioned between the first and second fluid line sections for permitting relative rotation therebetween so that the first line section and sensing bulb can rotate together with the hollow auger during construction of the piling.

1 Claim, 1 Drawing Sheet

APPARATUS FOR MONITORING GROUT PRESSURE DURING CONSTRUCTION OF AUGER PRESSURE GROUTED PILING

BACKGROUND OF THE INVENTION

1. Field of the Invention

The present invention relates generally to auger systems for constructing auger cast piling and, more particularly, to an apparatus for monitoring grout pressure in an auger assembly during construction of an auger pressure grouted pile.

2. Discussion of the Prior Art

It is known to form structural piles through the use of pressure grouting techniques, wherein a bore is formed in the earth at the site of a pile, and is filled with grout under pressure to complete the piling.

A conventional auger assembly for use in such operations includes an upright support frame that can be positioned adjacent a pile site and supported by means of a mobile crane or the like. An auger assembly is associated with the support frame, and includes an elongated, flighted auger having a hollow central shaft, and a support means for supporting the auger on the frame for relative rotational and vertical movement. A grout supply means is also provided in the form of a truck-mounted grout pump or the like for supplying grout through a flexible hose to the upper end of the auger during lifting thereof, the grout flowing through the auger and from the lower end into the bore.

During a pile-forming operation, the auger is rotated while down pressure is applied so that the auger is driven into the earth. When the auger has reached a desired depth, it is withdrawn, again being rotated to remove soil from the bore so formed. Simultaneously, fluid grout is directed under pressure through the auger shaft to cast the pile.

In order to ensure that the grout is supplied to the bore in an amount sufficient to fill the cross-sectional area of the bore as the auger is raised, it is necessary to monitor and control the supply of grout at all times during casting of the pile. Such control is normally achieved by calculating the necessary amount of grout to fill the bore, and supplying more than the calculated amount. In this manner, a head of grout is maintained in and around the auger at all times so that the entire cross-sectional area of the bore is filled throughout the height of the pile and any voids communicating with the bore are also filled.

The strength of a completed pile is dependent on proper placement or installation of the grout in the pile. One method of verifying proper casting includes the use of a pressure monitor in the grout line at the grout pump. In theory, by maintaining a minimum predetermined pressure at the pump, a sufficient pressure will exist at the lower end of the auger to ensure proper installation. However, in practice it is sometimes necessary to pump grout to a height of 80 feet or more above the ground to the upper end of the auger such that the pressure at the pump far exceeds the pressure at the lower end of the auger, and there is no guarantee that the pressure in the bore is greater than the predetermined minimum pressure desired.

OBJECTS AND SUMMARY OF THE INVENTION

It is an object of the present invention to provide an apparatus for monitoring the pressure of grout being supplied at the lower end of an auger so that a minimum desired pressure of the grout can be maintained to ensure proper installation of a pile.

It is another object of the invention to provide a pressure monitoring apparatus that provides verification of the grout pressure in the bore at all times during the construction of a pile. In this manner, it is possible to confirm that the entire cross-section of the bore has been filled throughout the bore's height, and that no voids are encountered during installation.

In accordance with these and other objects evident from the following description of a preferred embodiment of the invention, an apparatus is provided for monitoring grout pressure at the lower end of an auger assembly during construction of an auger pressure grouted piling (APG piling). The auger assembly with which the apparatus is used includes a hollow auger presenting a lower end adapted to penetrate the ground to form a bore and a means for raising the auger from the bore while supplying grout to the bore through the auger to form the piling.

The apparatus includes a pressure sensing means positioned within the auger at the lower end thereof for sensing the pressure exerted by the grout, and a pressure indicating means for indicating the pressure sensed by the sensing means. In addition, a pressure transmitting means transmits the pressure sensed at the sensing means to the indicator means. Preferably, the sensing means includes a fluid-filled pressure sensing bulb and the pressure transmitting means includes a high pressure fluid transmission line. Further, the high pressure line includes a first line section connected to the sensing bulb, a second line section connected to the pressure indicating means, and a swivel coupling positioned between the first and second line sections for permitting relative rotation therebetween. Thus, the first line section and sensing bulb can rotate together with the hollow auger during construction of the piling.

By providing a construction in accordance with the present invention, several advantages are realized. For example, the inventive apparatus represents a simple construction that is easy to assemble and use, and that provides reliable operation in the harsh environment of an auger assembly used in the formation of APG pilings. Another advantage obtained by employing the present invention resides in the provision of a sensing bulb capable of sensing any change in pressure at the lower end of the auger within the bore such that the change in pressure can be transmitted to the indicator means and monitored at all stages of installation. Thus, it is possible to verify that a predetermined minimum desired pressure has been maintained at all times during the formation of a pile.

BRIEF DESCRIPTION OF THE DRAWINGS FIGURES

The preferred embodiment of the invention is described in detail below with reference to the attached drawing figures, wherein.

DETAILED DESCRIPTION OF A PREFERRED EMBODIMENT

Figure 1:
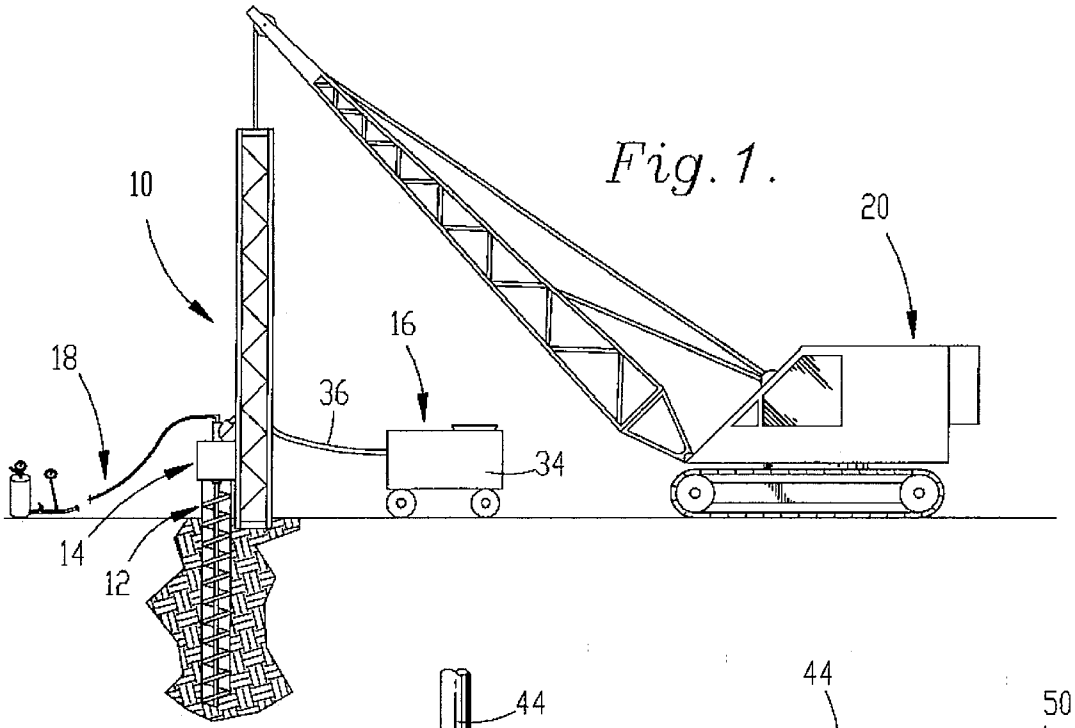
FIG. 1 is a schematic view of a system for constructing auger pressure grouted piling, including a grout pressure monitoring apparatus constructed in accordance with the preferred embodiment.

An auger assembly for use in the construction of auger pressure grouted piles is illustrated in FIG. 1, and broadly includes a frame 10, a hollow auger 12, a carriage 14 for supporting the auger on the frame, and a grout truck 16 or the like for supplying grout through a line to the auger. In addition, a pressure monitoring apparatus 18 is provided for monitoring the grout pressure at the lower end of the auger during installation.

The frame 10 is of conventional construction, and includes an upright, metallic, box-like structure presenting four elongated side frame members. The lower end of the frame is embedded in the ground a short distance, and a mobile crane 20 or the like is provided for stabilizing the frame in position while a pile is constructed.

Figure 2:
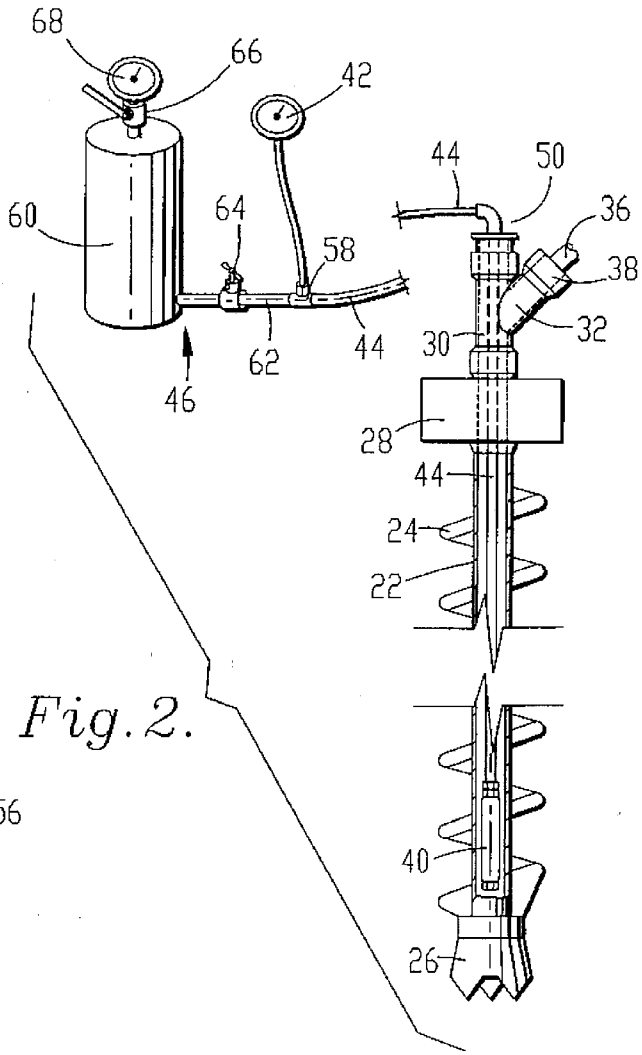
FIG. 2 is a fragmentary schematic view of the system, illustrating various components of the pressure monitoring apparatus.

The hollow auger 12 is shown in FIG. 2, and a central, upright, hollow shaft 22 and helical flighting secured to the exterior of the shaft. A bit 26 is provided at the lower end of the auger for penetrating the ground and forming a bore when the auger is rotated and down pressure applied. As with the auger 12, the bit 26 is hollow, allowing for grout to flow from the auger into the bore during installation of a pile. The auger is supported on a gear box 28 of the carriage for vertical movement relative to the frame, the gear box functioning as a means for rotating the auger to remove soil from the bore as the auger penetrates and is withdrawn from the ground. A pipe 30 extends upward from the gear box in line with the auger and includes a lateral branch 32 through which grout is supplied to the auger once it has been driven to the desired depth in the ground. The main branch of the pipe communicates with an upper opening adapted to receive the pressure monitoring apparatus 18, and also communicates with the hollow interior of the auger.

Returning to FIG. 1, the grout truck 16 is of conventional construction, and includes a supply of grout 34, a flexible hose 36 through which the grout is supplied to the upper end of the auger, and a pump for forcing the grout under pressure through the hose. As illustrated in FIG. 2, a conventional attachment 38 is provided for securing the hose to the branch line of the pipe at the upper end of the auger so that grout supplied to the auger enters the upper end of the auger and flows downward through the auger and bit into the bore.

Figure 4:
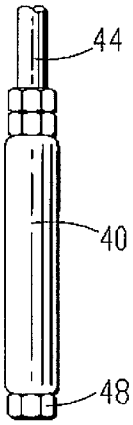
FIG. 4 is a side elevational view of a sensing bulb forming a part of the apparatus.

The pressure monitoring apparatus 18 generally includes a sensing bulb 40, a pressure indicator 42, a high pressure line 44 providing fluid communication between the pressure bulb and indicator, and a charging assembly 46 for charging the apparatus with fluid. The pressure bulb 40 is shown in FIG. 4, and is formed of a short length of tubing presenting a hollow interior that is filled with fluid during use. The material used to construct the bulb is flexible and compressible such that ambient pressure is transmitted through the bulb to the fluid therein. An exemplary material for use in the bulb is a quarter-inch inner diameter, non-reinforced nitrile rubber. A threaded closure cap 48 is provided on the distal end of the bulb and closes off the pressure bulb when in place. The closure cap can be removed from the bulb during charging of the apparatus to allow air in the system to be replaced with fluid. Once charging is complete, the closure cap can be replaced to close the system. The proximal end of the bulb is provided with a threaded coupling that permits the bulb to be connected in fluid communication with the high pressure line 44.

Returning to FIG. 2, the high pressure line 44 is also hollow, presenting an inner diameter equal to the inner diameter of the sensing bulb. The material used in the high pressure line is selected to withstand much higher pressures than the sensing bulb, and preferably includes a reinforced nitrile rubber. An exemplary material is a quarter-inch inner diameter, two-strand, 2500 psi reinforced nitrile rubber. The high pressure line includes a first line section connected between the sensing bulb 40 and a swivel coupling 50 at the upper end of the auger, and a second line section connected between the swivel coupling and the pressure indicator 42. Preferably, the first line section is further broken down into segments of incremental length so that the first section of the line can be assembled in each instance to properly position the bulb at the lower end of the auger adjacent the bit. For example, a 40-foot segment can be used in combination with several additional five or ten-foot segments to permit the assembly of the line on an auger having a length of 40 feet or more.

Each segment of the first line section includes a threaded coupling at each end for permitting the segments to be connected together in any order between the sensing bulb 40 and the swivel coupling 50 at the upper end of the auger. Each of the segments provide fluid communication with one another so that a pressure exerted on the bulb is transmitted through the fluid contained in the pressure bulb and the first line section.

Figure 3:
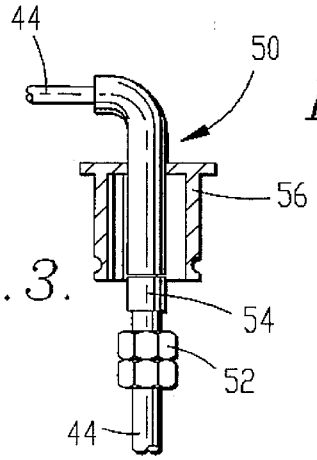
FIG. 3 is a sectional view of a hose connection assembly forming a part of the apparatus.

The swivel coupling at the upper end of the auger is illustrated in FIG. 3, and includes a threaded coupling 52 for connection to the first line section of the high pressure line 44 and a swivel 54 for permitting the first line section to rotate with the auger relative to the frame 10. A cap 56 is provided for securing the swivel coupling 50 within the main branch of the pipe 30 connected to the carriage, and any conventional means can be employed for securing the cap in place during use. For example, a simple hand-actuated cam lever can be employed for engaging a notch on the side of the cap to hold it in place during use. The second line section of the high pressure line 44 is connected to the swivel coupling 50 by a threaded coupling or other conventional means not shown.

The indicator 42 is shown in FIG. 2, and includes a conventional fluid-actuated pressure gauge for displaying the pressure of the fluid in the system. Alternately, it is possible to connect the second line section with any other type of pressure sensing device such as a transducer in order to display or analyze the pressure sensed at the pressure bulb. For example, numerous devices are presently available for recording pressure information obtained at the pump of a grout truck, and such devices could be used to analyze pressure data obtained by the monitoring apparatus of the present invention.

The second line section communicates with the pressure indicator 42 through a T-fitting 58, and the charging assembly also communicates with the second line section through this fitting. The charging assembly 46 includes a pressure vessel or reservoir 60 for storing the fluid to be used in the system, a line 62 connecting the vessel with the fitting 58, and a charging valve 64 disposed in the line. Preferably, the fluid in the vessel is pressurized by the introduction of compressed air into a valve 66 at the top of the vessel, and this pressure is sufficient to force fluid from the vessel through the high pressure line 44 and sensing bulb 40 during charging. A separate pressure gauge 68 is associated with the valve on the vessel for indicating the pressure in the vessel.

During operation, once the pressure monitoring apparatus has been assembled on the auger, the closure cap 48 is removed from the sensing bulb, compressed air is supplied to the pressure vessel 60, and the charging valve 64 is opened so that fluid is supplied from the vessel through both line sections of the high pressure line 44 to the bulb 40. Preferably, a low viscosity hydraulic oil is used as the fluid. However, other fluids could also be used.

Once the system is filled with fluid, the closure cap 48 is replaced on the sensing bulb and the charging valve is closed. Any remaining pressure in the vessel can then be relieved through the valve 66. Thereafter, the indicator will provide a display of any change in pressure resulting from compression of the sensing bulb at the lower end of the auger. Thus, as grout is supplied to the auger and fills the bore, a head of grout forms both within the auger and around it, and this head is sensed by the bulb. The height of the head is directly related to the pressure exerted at the bulb and at the lower end of the auger, and thus is a very accurate indication of the pressure of the grout filling the bore.

By monitoring the pressure at the lower end of the auger and maintaining a grout pressure above a predetermined minimum desired pressure, an operator can ensure that the grout is filling the cross-section of the bore as the auger is lifted therefrom. In addition, if any voids are encountered such that more grout is necessary than would normally be the case, a drop in pressure at the sensing bulb will occur, providing an indication to the operator of such an event. Thus, the operator will know the depth and extent of the void immediately upon observing the indicator, and will be able to react accordingly.

For example, in a typical operation, it is desired to maintain a predetermined positive grout pressure at the bit, and with the present invention an operator is able to maintain this pressure range without introducing insufficient or excessive pressures into the bore. As mentioned, insufficient pressure might result in a less than complete cross-section of the bore being filled with grout. In contrast, an excessive pressure would cause the auger to lock up within the bore, straining the auger and gear box.

Although the present invention has been described with reference to the preferred embodiment illustrated in the attached drawing figures, it is noted that substitutions may be made and equivalents employed herein without departing from the scope of the invention as recited in the claims. For example, an electrical equivalent to the fluid-actuated monitoring apparatus can be provided which includes a transducer functioning as the sensing means and an electrical transmission line for transmitting the sensed pressure to an electrical pressure indicator. In this alternate construction, the transducer is supported by a first line section of the transmission line that is connected to a sealed electrical swivel at the top of the auger. A second line section extends between the swivel and the indicator. Thus, the transducer and first line section are free to rotate with the auger without affecting the transmission of electrical pressure-indicative signals to the indicator.

What is claimed is:

1. An apparatus for constructing an auger pressure grouted piling, comprising:

a frame supported on the ground adjacent a position at which an auger cast piling is to be formed;

a hollow auger presenting a lower end adapted to penetrate the ground and an upper end opposing the lower end;

a support means for supporting the auger on the frame for relative rotational and vertical movement, the support means including a driving means for rotating and lowering the auger into the ground to form a bore, and for lifting the auger relative to the frame once the bore is complete;

a grout supply means for supplying grout to the upper end of the auger during lifting of the auger, the grout flowing through the auger and from the lower end into the bore;

a pressure sensing means positioned entirely within the auger adjacent the lower end for sensing the pressure exerted by the grout in the lower end of the auger, said pressure sensing means comprising a compressible fluid-filled pressure sensing bulb;

a pressure indicating means proximal to said frame for indicating the pressure sensed by the sensing means;

a pressure transmitting means extending between the sensing means and the pressure indicating means for transmitting the pressure sensed by the sensing means to the indicator means, said pressure transmitting means including a high pressure fluid transmission line reinforced against expansion, the line extending from the upper end of and through the length of said auger and being in fluid communication with said bulb and said pressure indicating means for transmitting fluid pressure between the bulb and the indicating means, said fluid transmission line including a first line section connected to the sensing bulb, a second line section connected to the pressure indicating means, and a swivel coupling positioned between the first and second line sections for permitting relative rotation therebetween so that the first line section and sensing bulb can rotate together with the hollow auger, said high pressure fluid transmission line being capable of withstanding significantly higher pressures than said sensing bulb such that the pressure indicated by said indicating means is the ambient pressure of the grout adjacent the lower end of said auger.

* * * * *